US008292006B2

(12) United States Patent
Scott et al.

(10) Patent No.: US 8,292,006 B2
(45) Date of Patent: Oct. 23, 2012

(54) DIAMOND-ENHANCED CUTTING ELEMENTS, EARTH-BORING TOOLS EMPLOYING DIAMOND-ENHANCED CUTTING ELEMENTS, AND METHODS OF MAKING DIAMOND-ENHANCED CUTTING ELEMENTS

(75) Inventors: Danny E. Scott, Montgomery, TX (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 419 days.

(21) Appl. No.: 12/508,440

(22) Filed: Jul. 23, 2009

(65) Prior Publication Data

US 2011/0017517 A1 Jan. 27, 2011

(51) Int. Cl.
*E21B 10/46* (2006.01)

(52) U.S. Cl. ..... 175/434; 175/374; 175/426

(58) Field of Classification Search ..... 175/374, 175/434, 426

See application file for complete search history.

(56) References Cited

U.S. PATENT DOCUMENTS

| | | | | |
|---|---|---|---|---|
| 4,604,106 | A | 8/1986 | Hall | |
| 4,694,918 | A | 9/1987 | Hall | |
| 5,304,342 | A | 4/1994 | Hall, Jr. et al. | |
| 5,370,195 | A | 12/1994 | Keshavan et al. | |
| 5,641,921 | A | 6/1997 | Dennis et al. | |
| 5,766,394 | A | 6/1998 | Anderson et al. | |
| 6,199,645 | B1 | 3/2001 | Anderson et al. | |
| 6,214,079 | B1 | 4/2001 | Kear et al. | |
| 6,443,248 | B2 | 9/2002 | Yong et al. | |
| 6,454,027 | B1 | 9/2002 | Fang et al. | |
| 6,460,636 | B1 | 10/2002 | Yong et al. | |
| 6,460,637 | B1 | 10/2002 | Siracki et al. | |
| 6,484,826 | B1 | 11/2002 | Anderson et al. | |
| 2004/0105806 | A1 * | 6/2004 | Griffin et al. | 423/446 |
| 2005/0211475 | A1 | 9/2005 | Mirchandani et al. | |
| 2008/0223623 | A1 * | 9/2008 | Keshavan et al. | 175/434 |
| 2008/0230280 | A1 * | 9/2008 | Keshavan et al. | 175/434 |
| 2011/0017517 | A1 * | 1/2011 | Scott et al. | 175/374 |
| 2012/0080240 | A1 * | 4/2012 | Green et al. | 175/428 |

FOREIGN PATENT DOCUMENTS

EP 0219959 B1 4/1992

OTHER PUBLICATIONS

International Search Report for International Application No. PCT/US2010/042341 mailed Feb. 21, 2011, 3 pages. International Written Opinion for International Application No. PCT/US2010/042341 mailed Feb. 21, 2011, 3 pages.

Jeremy W. Peterson; PCD in the Fast Lane, Cutting Tools Engineering Magazine, Jun. 2008, vol. 60, Issue 6.

Federico Bellin et al., The current state of PDC bit technology, World Oil, Sep. 2010, pp. 41-46.

* cited by examiner

*Primary Examiner* — Jennifer H Gay
(74) *Attorney, Agent, or Firm* — TraskBritt

(57) ABSTRACT

Cutting elements for use in earth-boring applications include a substrate, a transition layer, and a working layer. The transition layer and the working layer comprise a continuous matrix phase and a discontinuous diamond phase dispersed throughout the matrix phase. The concentration of diamond in the working layer is higher than in the transition layer. Earth-boring tools include at least one such cutting element. Methods of making cutting elements and earth-boring tools include mixing diamond crystals with matrix particles to form a mixture. The mixture is formulated in such a manner as cause the diamond crystals to comprise about 50% or more by volume of the solid matter in the mixture. The mixture is sintered to form a working layer of a cutting element that is at least substantially free of polycrystalline diamond material and that includes the diamond crystals dispersed within a continuous matrix phase formed from the matrix particles.

39 Claims, 4 Drawing Sheets

DIAMOND-ENHANCED CUTTING ELEMENTS, EARTH-BORING TOOLS EMPLOYING DIAMOND-ENHANCED CUTTING ELEMENTS, AND METHODS OF MAKING DIAMOND-ENHANCED CUTTING ELEMENTS

FIELD

Embodiments of the present invention relate to diamond-enhanced cutting elements for use in earth-boring tools for drilling subterranean formations, to earth-boring tools including such diamond-enhanced cutting elements, and to methods of making and using such cutting elements and earth-boring tools.

BACKGROUND

Drill bits for drilling subterranean rock formations employ cutting elements to remove the underlying earth structures. However, as drilling proceeds the cutting elements begin to wear and fracture, causing premature failure of the bit. When the cutting elements wear down to the point of needing replacement, the entire drilling operation must be shut down to replace the drill bit, costing significant time and money. It is therefore desirable to maximize the cutting elements' useful life by increasing their resistance to damage through both wear and impact.

Typical materials exhibiting suitable characteristics for use in cutting elements include refractory metals, metal carbides, such as tungsten carbide (WC), and superhard materials, such as diamond. Diamond is resistant to wear, but is brittle and tends to fracture and spall in use. Cemented WC, on the other hand, is more ductile and resistant to impact, but tends to wear more quickly than diamond. Many attempts have been made to marry the wear resistance of diamond to the impact resistance of WC in earth-boring drill bit cutting elements. Cutting elements are typically composed of a PCD layer or compact formed on and bonded under high-pressure and high-temperature conditions to a supporting substrate such as cemented WC, although other configurations are known. A binder material, such as nickel, molybdenum, cobalt, and alloys thereof, is used to cement the WC and the PCD layer together, creating a continuous matrix to hold the WC and PCD layer in place.

The outermost or working layer of such a cutting element comprises a PCD layer wherein intercrystalline bonding occurs between adjacent diamond crystals. The PCD layer has a continuous PCD phase and a continuous matrix phase throughout. Accordingly, a substantially complete and substantially intact layer of PCD would remain if the layer of PCD were leached of all binder content. To improve bonding between the PCD layer and the substrate, transition layers may be interposed between the substrate and the working layer wherein gradually increasing concentrations of PCD or diamond grit are introduced into the continuous matrix phase in each layer.

BRIEF SUMMARY

In some embodiments, the present invention includes cutting elements for use in subterranean drilling applications. The cutting elements include a substrate, at least one transition layer bonded to the substrate, and a working layer bonded to the at least one transition layer on a side thereof opposite the substrate. The at least one transition layer includes a continuous first matrix phase and a discontinuous first diamond phase dispersed throughout the first matrix phase. The volume percentage of the first diamond phase in the at least one transition layer is about 50% or less. The working layer includes a continuous second matrix phase and a discontinuous second diamond phase dispersed throughout the second matrix phase. The volume percentage of the second diamond phase in the working layer is at least about 50%, and the volume percentage of the second diamond phase in the working layer is greater than the volume percentage of the first diamond phase in the at least one transition layer. The working layer may be at least substantially free of polycrystalline diamond material.

In additional embodiments, the present invention includes earth-boring tools that include a body and at least one cutting element carried by the body. The cutting element includes a cutting element substrate that is secured to the body, at least one transition layer bonded to the substrate, and a working layer bonded to the at least one transition layer on a side thereof opposite the substrate. The at least one transition layer includes a continuous first matrix phase and a discontinuous first diamond phase dispersed throughout the first matrix phase. The working layer includes a continuous second matrix phase and a discontinuous second diamond phase dispersed throughout the second matrix phase. A volume percentage of the second diamond phase in the working layer is greater than a volume percentage of the first diamond phase in the at least one transition layer. The discontinuous second diamond phase is at least substantially comprised by isolated single diamond crystals, or isolated clusters of diamond crystals, at least substantially surrounded by the second matrix phase.

In additional embodiments, the present invention includes methods of fabricating cutting elements and earth-boring tools including such cutting elements. In accordance with such embodiments, a first plurality of discrete diamond crystals may be mixed with a first plurality of matrix particles each comprising a first metal matrix material to form a first mixture of solid matter. The first mixture is formulated such that the first plurality of discrete diamond crystals comprises about 50% by volume or less of the solid matter of the first mixture. A second plurality of discrete diamond crystals is mixed with a second plurality of matrix particles each comprising a second metal matrix material to form a second mixture. The second mixture is formulated such that the second plurality of discrete diamond crystals comprises at least about 50% by volume of the solid matter of the second mixture. The first mixture is sintered to form a transition layer including the first plurality of discrete diamond crystals dispersed within a continuous first matrix phase formed from the first plurality of matrix particles. The second mixture is sintered to form a working layer including the second plurality of discrete diamond crystals dispersed within a continuous second matrix phase formed from the second plurality of matrix particles. The transition layer is bonded to a substrate, and the working layer is bonded to the transition layer on a side thereof opposite the substrate.

BRIEF DESCRIPTION OF THE DRAWINGS

While the specification concludes with claims particularly pointing out and distinctly claiming that which is regarded as the present invention, various features and advantages of embodiments of this invention may be more readily ascertained from the following description of embodiments of the invention when read in conjunction with the accompanying drawings, in which:

DETAILED DESCRIPTION

The illustrations presented herein are not meant to be actual views of any particular earth-boring tool, cutting element, or microstructure of a cutting element, but are merely idealized representations that are employed to describe embodiments of the present invention. Additionally, elements common between figures may retain the same numerical designation.

Figure 1:
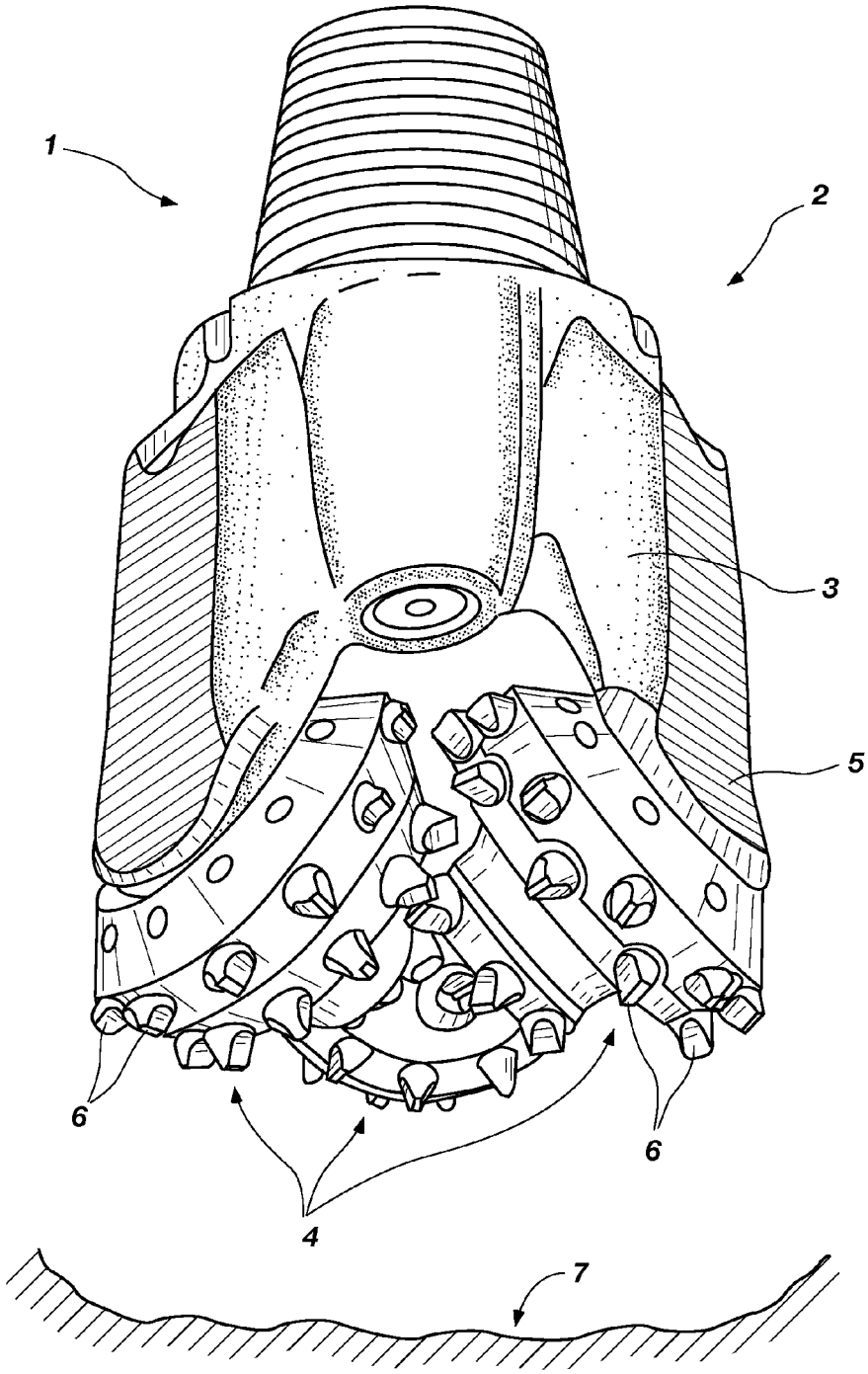
FIG. 1 is a perspective view of an embodiment of an earth-boring tool of the present invention.

An embodiment of an earth-boring tool of the present invention, which may be used in subterranean drilling applications, is illustrated in FIG. 1. The earth-boring tool 1 shown in FIG. 1 is a roller cone rotary drill bit 2 having a bit body 3 and three roller cones 4. Each roller cone 4 is mounted to a bearing pin that is integrally formed with, and depends from one of three bit legs 5. The three bit legs 5 may be welded together to form the bit body 3 of the drill bit 2. A plurality of cutting elements 6, as described in further detail below, are carried by and bonded to each of the cones 4. As the drill bit 2 is rotated within a wellbore while an axial force is applied to the drill bit (often referred to in the art as "weight-on-bit" or "WOB"), the cones 4 roll and slide across the underlying formation 7, which causes the cutting elements 6 to crush, scrape, and shear away the underlying formation 7.

In some embodiments, the cones 4 may be machined from a forged or cast steel body. In such cones 4, recesses may be drilled or otherwise formed in the outer surface of the cones 4, and the cutting elements 6 may be inserted into the recesses and secured to the cone 4 using, for example, a shrink fit, press fit, an adhesive, a brazing alloy, etc. In additional embodiments, the cones 4 may be formed using a pressing and sintering process, and may comprise a particle-matrix composite material such as, for example, a cemented carbide material (e.g., cobalt-cemented tungsten carbide). In such cones 4, recesses may be formed in the outer surface of the cones 4 prior to sintering, and the cutting elements 6 may be inserted into the recesses and secured to the cone 4 after sintering using, for example, a shrink fit, press fit, an adhesive, a brazing alloy. In other embodiments, the cutting elements 6 may be inserted into the recesses prior to sintering, and the cutting elements 6 may bond to the cones 4 during the sintering process.

Figure 2:
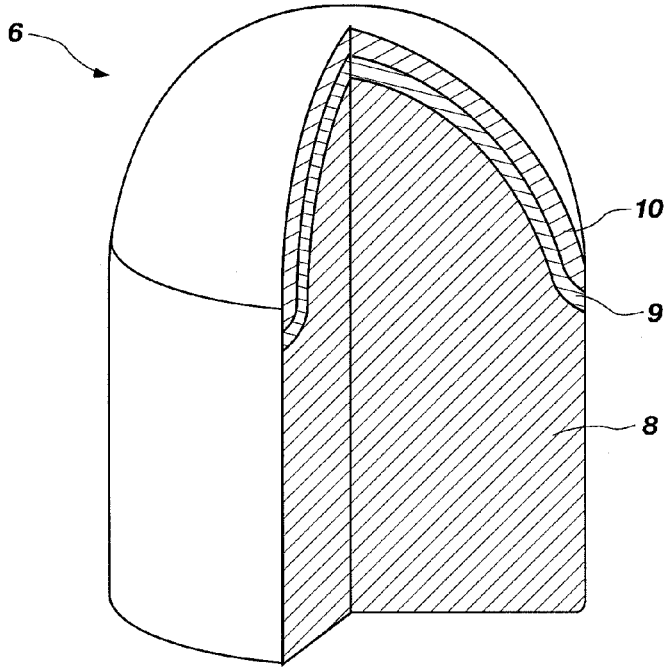
FIG. 2 is a partially cut-away perspective view of an embodiment of a cutting element of the present invention.

A cutting element 6 in accordance with one embodiment of the present invention is shown in FIG. 2. The cutting element 6 includes a cutting element substrate 8, a transition layer 9, and a working layer 10. The transition layer 9 is bonded to and interposed between the substrate 8 and the working layer 10. In some embodiments, the substrate 8 may comprise a generally cylindrical body having a generally dome-shaped, ovoid-shaped, conical, or chisel-shaped end, and the transition layer 9 and the working layer 10 may be disposed on a surface of the generally dome-shaped, ovoid-shaped, conical, or chisel-shaped end of the generally cylindrical body of the substrate 8. Further, the transition layer 9 and working layer 10 may not be limited to the working end or portion of the cutting element 6, but may extend along the entire side to the opposing end of the cutting element 6.

Figure 3:
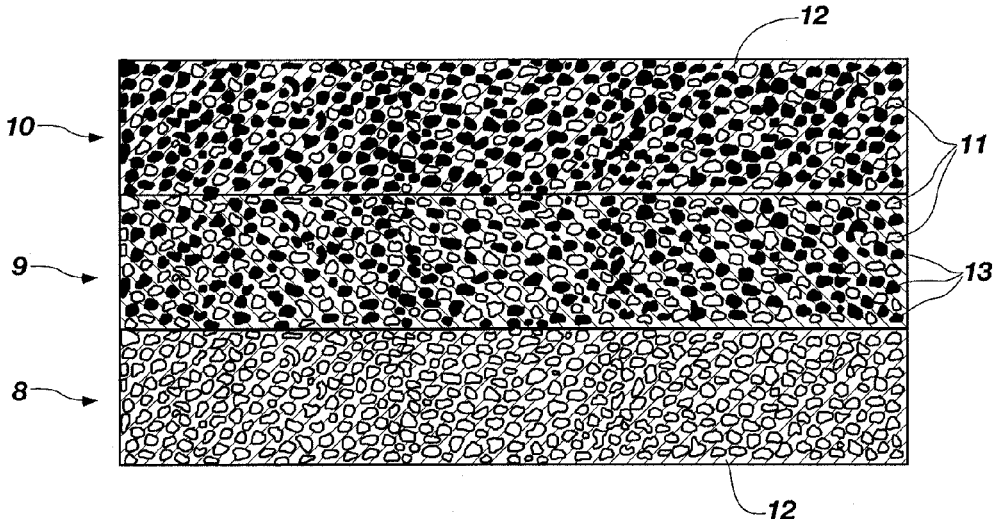
FIG. 3 is a simplified drawing illustrating how a microstructure of outer layers of the cutting element of FIG. 2 may appear under magnification.

FIG. 3 is a simplified drawing illustrating how a microstructure of the substrate 8, the transition layer 9, and the working layer 10 may appear under magnification. As shown in FIG. 3, each of the substrate 8, the transition layer 9, and the working layer 10 of the cutting element 6 (FIGS. 1 and 2) may comprise a composite material that includes more than one phase.

The substrate 8 may comprise, for example, a discontinuous hard phase 11 dispersed through a continuous matrix phase 12 (often referred to as a "binder"). The discontinuous hard phase 11 may be formed from and comprise a plurality of hard particles. The material of the discontinuous hard phase 11 may comprise, for example, a carbide material (e.g., tungsten carbide, tantalum carbide, titanium carbide, etc.). The continuous matrix phase 12 may comprise a metal or metal alloy, such as, for example, cobalt or a cobalt-based alloy, iron or an iron-based alloy, or nickel or a nickel-based alloy. In such embodiments, the matrix phase 12 acts as a binder or cement in which the carbide phase regions are embedded and dispersed. Thus, such materials are often referred to in the art as "cemented carbide materials." As a non-limiting example, the discontinuous hard phase 11 may comprise between about 80% and about 95% of the substrate 8 by weight, and the continuous matrix phase 12 may comprise between about 5% and about 20% of the substrate 8 by weight.

In some embodiments, the continuous matrix phase 12 may comprise a metal alloy based on at least one of cobalt, iron, and nickel, and may include at least one melting point reducing constituent, such that the metal alloy of the continuous matrix phase 12 has one of a melting point and a solidus point at about 1200° C. or less. Such metal alloys are disclosed in, for example, U.S. Patent Application Publication No. 2005/0211475 A1, which was published Sep. 29, 2005, and entitled EARTH-BORING BITS, the disclosure of which publication is incorporated herein in its entirety by this reference.

A portion of the transition layer 9 may have a composition similar to that of the substrate 8. The transition layer 9 may further comprise, however, a discontinuous diamond phase 13. In other words, the transition layer 9 may comprise a discontinuous diamond phase 13 and another discontinuous hard phase 11 (e.g., a carbide material, as previously mentioned), and the discontinuous diamond phase 13 and the another discontinuous hard phase 11 may be dispersed within a continuous metal matrix phase 12 as previously described in relation to the substrate 8. The discontinuous diamond phase 13 may be formed from and comprise a plurality of individual and discrete diamond crystals (i.e., diamond grit).

Like the transition layer 9, the working layer 10 may also comprise three phases including a discontinuous diamond phase 13 and another discontinuous hard phase 11 dispersed within a metal matrix phase 12 as previously described in relation to the substrate 8 and the transition layer 9. Each of the transition layer 9 and the working layer 10 may be at least substantially free of polycrystalline diamond material. In other words, the diamond crystals within each of the transition layer 9 and the working layer 10 may be at least substantially separated from one another by the discontinuous hard phase 11 and the matrix phase 12, such that each of the transition layer 9 and the working layer 10 is at least substantially free of inter-granular diamond-to-diamond bonds. In other words, the diamond material within the transition layer 9 and the working layer 10 may be at least substantially comprised by isolated single diamond crystals or clusters of crystals that are at least substantially surrounded by the matrix phase 12 and the discontinuous hard phase 11.

The concentration of diamond material in the working layer 10 may be higher than the concentration of diamond material in the transition layer 9. The volume percentage of the diamond phase 13 within the transition layer 9 may comprise about 50% or less. In other words, the total volume of the diamond phase 13 within the transition layer 9 may be about 50% or less of the total volume of the transition layer 9. The volume percentage of the diamond phase 13 within the working layer 10 may comprise about 50% or more. In other words, the total volume of the diamond phase 13 within the working layer 10 may be at least about 50% of the total volume of the working layer 10.

As one non-limiting example, the volume percentage of the diamond phase 13 within the working layer 10 may be about 85% or less. More particularly, the volume percentage of the diamond phase 13 within the working layer 10 may be between about 65% and about 85% (e.g., about 75%), and the volume percentage of the diamond phase 13 within the transition layer 9 may be between about 35% and about 65% (e.g., about 50%). In the embodiment shown in FIGS. 2 and 3, the hard particles 11 and the continuous matrix phase 12 may comprise about 30%-80% of the transition layer 9 by volume, while the diamond particles 13 may comprise about 20%-50% of the transition layer 9 by volume. Preferably, the hard particles 11 and the continuous matrix phase 12 comprise about 50% of the transition layer 9 by volume, while the diamond particles 13 comprise about 50% of the transition layer 9 by volume.

While the diamond particles 13 are shown in FIG. 3 as being distributed at least substantially uniformly throughout the thickness of the transition layer 9 and the working layer 10, in other embodiments the diamond particles may vary in concentration throughout the thickness of the layers. For example, the diamond particles 13 in the transition layer 9, or layers, may exist in a lower concentration in a region of the transition layer 9, or layers, near the substrate 8 and increase in concentration to a higher concentration of diamond particles in a region of the transition layer 9, or layers, near the working layer 10, forming a gradient of diamond particles 13 across the thickness of the transition layer 9, or layers. Thus, while separate and distinct layers for the working layer 10 and the transition layer 9, or layers, may be discernable, the diamond particles 13 in each layer may form a varying gradient in concentration across the thickness of each layer.

In addition, the diamond particles 13 in the working layer 10 and the transition layer 9, or layers, may vary in concentration longitudinally from the apex of the dome-shaped cutter tip toward the substrate 8. For example, the diamond particles may exist in a greater concentration near the apex of the working layer 10 or transition layer 9, and gradually decrease in concentration as distance from the apex within the layer increases. Thus, the diamond particles 13 in each layer may form a varying gradient in concentration across the thickness of each layer, along the length of each layer as it leads away from the apex of the cutting element tip, or both. In other words, the diamond particles 13 may form a gradient in concentration within each layer.

As previously mentioned, the discontinuous hard phase 11 may be formed from and comprise hard particles, and the discontinuous diamond phase 13 may be formed from and comprise diamond crystals. The average particle size of the hard particles used to form the hard phase 11 and the average particle size of the diamond crystals used to form the diamond phase 13 may be between about ten nanometers (10 nm) and about one hundred microns (100 μm). More particularly, the average particle size of the hard particles used to form the hard phase 11 and the average particle size of the diamond crystals used to form the diamond phase 13 may be between about one hundred nanometers (100 nm) and about one hundred microns (100 μm). In some embodiments, the average particle size of the hard particles used to form the hard phase 11 may be substantially similar to the average particles of the diamond crystals used to form the diamond phase 13. In other embodiments, the average particle size of the hard particles used to form the hard phase 11 may differ from the average particles of the diamond crystals used to form the diamond phase 13. As a non-limiting example, the hard particles used to form the hard phase 11 may comprise a mixture of particles of non-uniform size and ranging from two to ten microns (2-10 μm) in size.

While the diamond particles 13 and the hard particles 11 in FIG. 3 are depicted as being approximately equal in average size and of uniform average size throughout each layer, each particle may exist within the layers in varying sizes. Furthermore, each of the diamond phase 13 and the hard phase 11 may comprise particles that vary in size, including relatively small particles, relatively large particles, and particles of varying sizes in between. For example, each of the diamond particles 13 and the particles of the hard phase 11 may comprise a mixture of particles ranging in size from about ten nanometers (10 nm) to about one hundred microns (100 μm). The particles of the diamond phase 13 and the hard phase 11 may be distributed at random, or may be distributed such that a gradient in average particle size is discernable across the thickness of each layer, along the length of each layer extending away from the apex of the cutting element tip, or both. In other words, the diamond particles 13 and the particles of the hard phase 11 may form a gradient in average particle size within each layer.

Figure 4:
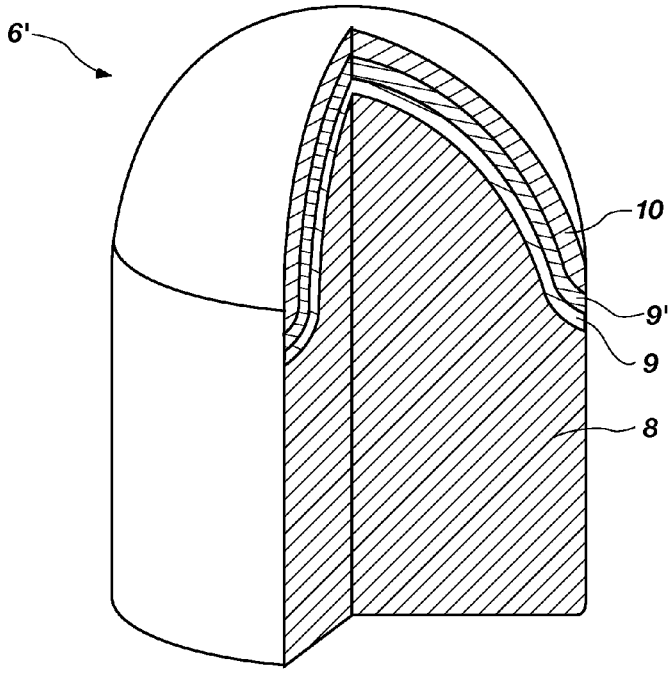
FIG. 4 is a partially cut-away perspective view of another embodiment of a cutting element of the present invention.

As previously mentioned, embodiments of cutting elements of the present invention may include more than one transition layer between the substrate and the working layer. FIG. 4 illustrates another embodiment of a cutting element 6' in accordance with the present invention that includes two transition layers. As shown therein, the cutting element 6' includes a substrate 8, a first transition layer 9, a second transition layer 9', and a working layer 10. The substrate 8 and the working layer 10 of the cutting element 6' may be at least substantially identical to the substrate 8 and the working layer 10 of the cutting element 6 previously described in relation to FIGS. 2 and 3. Each of the transition layers 9, 9' of the cutting element 6' may be generally similar to the transition layer 9 of the cutting element 6 previously described in relation to FIGS. 2 and 3.

The transition layers 9 and 9' may be bonded to one another and interposed between the substrate 8 and the working layer 10 such that a first transition layer 9 is bonded to the substrate 8 and a second transition layer 9' is bonded to the working layer 10. In other words, the first transition layer 9 may be bonded directly to the substrate 8. The second transition layer 9' may be interposed between and bonded directly to the first transition layer 9 and the working layer 10.

Figure 5:
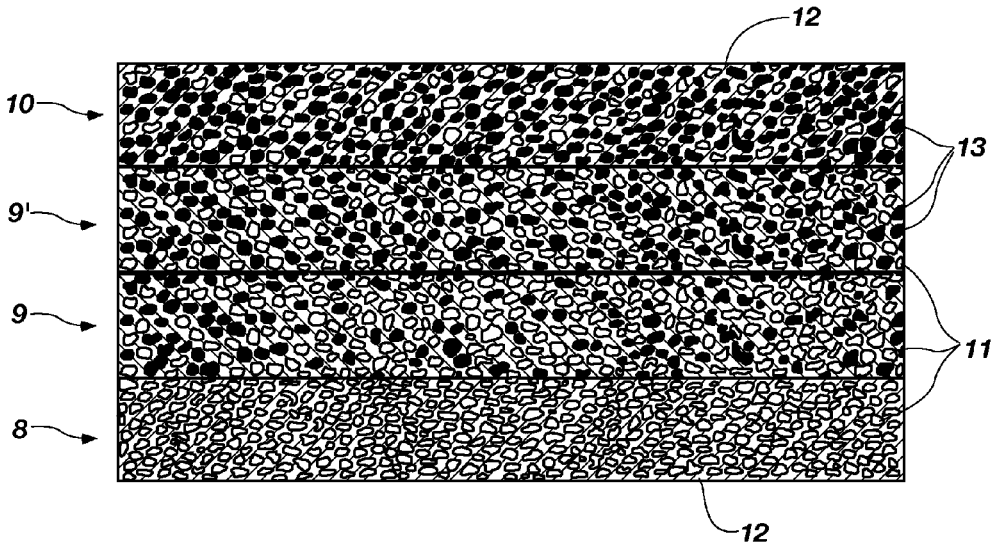
FIG. 5 is a simplified drawing illustrating how a microstructure of outer layers of the cutting element of FIG. 4 may appear under magnification.

The substrate 8, the first transition layer 9, the second transition layer 9', and working layer 10 of the cutting element 6' may each comprise a composite material including more than one phase of material. FIG. 5 is similar to FIG. 3 and is a simplified drawing illustrating how a microstructure of the substrate 8, the first transition layer 9, the second transition layer 9', and the working layer 10 of the cutting element 6' of FIG. 4 may appear under magnification. As shown in FIG. 5, each of the first transition layer 9, the second transition layer 9', and the working layer 10 includes a discontinuous diamond phase 13 dispersed throughout a continuous matrix phase 12, as previously described in relation to FIGS. 2 and 3. Each of the first transition layer 9, the second transition layer 9', and the working layer 10 may further include another discontinuous hard phase 11 (e.g., a carbide material such as, for example, tungsten carbide, tantalum carbide, or titanium carbide) dispersed throughout the matrix phase 12, as previously described in relation to FIGS. 2 and 3.

The second transition layer 9' may comprise a higher concentration of diamond phase 13 than the first transition layer 9, and the working layer 10 may comprise a higher concentration of diamond phase 13 than each of the transition layers 9, 9'. In other words, the second transition layer 9' may comprise more diamond by volume than the first transition layer 9. As a non-limiting example, the first transition layer 9 may comprise between about 10% and about 37% diamond by volume (e.g., about 25%), the second transition layer 9' may comprise between about 37% and about 63% diamond by volume (e.g., about 50%), and the working layer 10 may comprise between about 63% and about 85% diamond by volume (e.g., about 75%).

Additional embodiments of cutting elements of the present invention may comprise three, four, or even more transition layers between the substrate 8 and the working layer 10. Furthermore, in some embodiments, the concentration of diamond may increase at least substantially continuously from the substrate 8 to the working layer 10, such that no discernible boundary exists between the substrate 8, the intermediate layer or layers, and the working layer 10.

Figure 6:
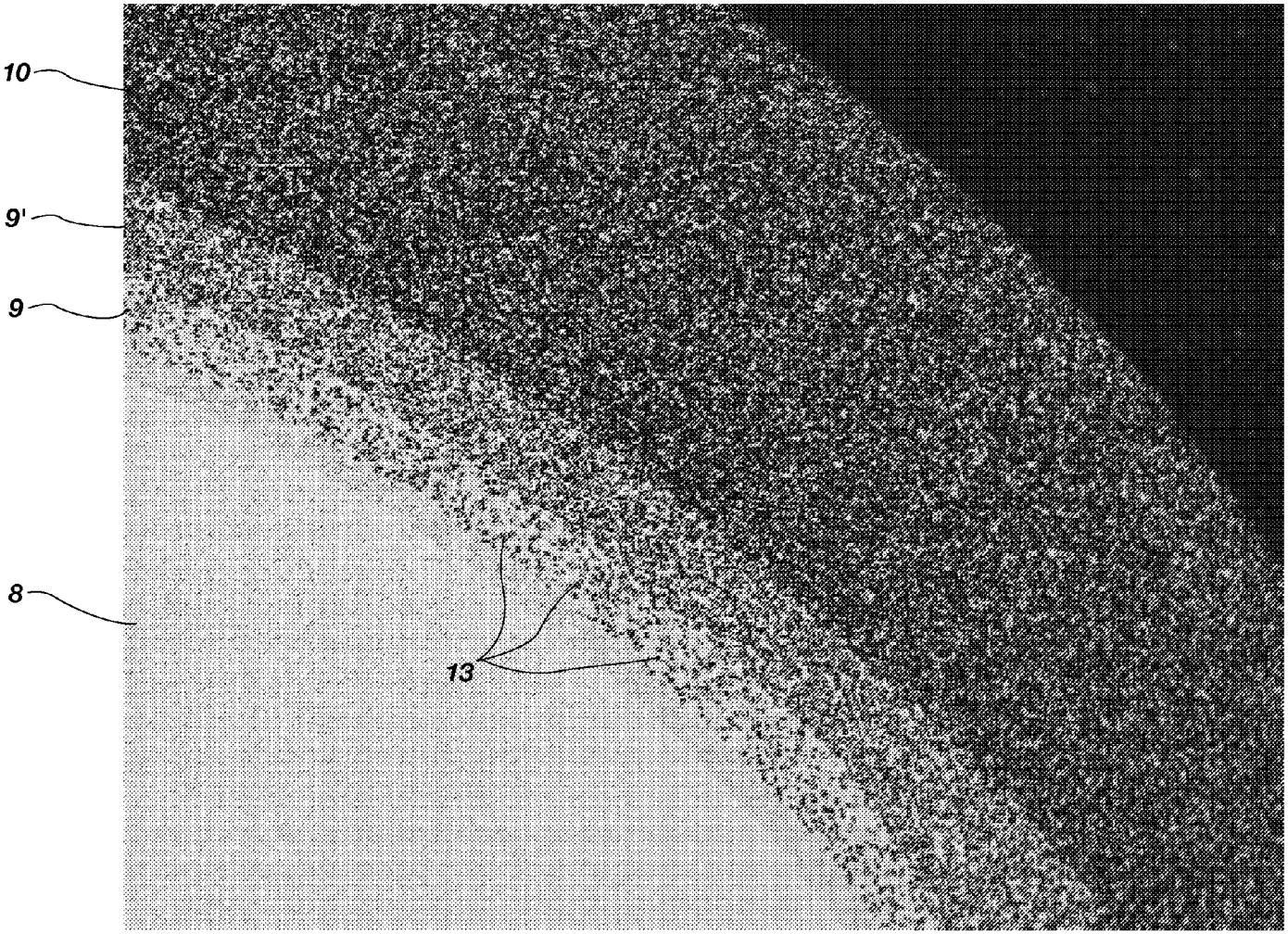
FIG. 6 is a photomicrograph of a substrate, transition layers, and a working layer in accordance with an embodiment of the invention.

FIG. 6 shows a photomicrograph of a substrate 8, transition layers 9 and 9', and a working layer 10 in accordance with an embodiment of the invention. As shown in FIG. 6, at least substantially all of the finite regions of the discontinuous diamond phase 13 in the working layer 10 are not bonded directly to one another to form a polycrystalline diamond material. In other words, the working layer 10 is at least substantially free of direct diamond-to-diamond bonds between the diamond crystals in the working layer 10, such that the working layer 10 is at least substantially free of polycrystalline diamond material. To determine whether a working layer 10 is at least substantially free of polycrystalline diamond material, the working layer 10 may be leached with an acid in accordance with methods known in the art for removing catalyst material from interstitial spaces between diamond crystals in polycrystalline diamond material. In accordance with embodiments of the present invention in which the working layer 10 is at least substantially free of polycrystalline diamond material, when the working layer 10 is leached, the diamond crystals in the working layer 10 separate and fall away from the substrate 8, since the diamond crystals are isolated from one another or are present in isolated clusters and do not form a self-supporting structure.

It is known in the art to form cutting elements that include a working layer that is substantially comprised of a polycrystalline diamond material. Such cutting elements are formed using what are referred to in the art as "high temperature, high pressure" (or "HTHP") processes and systems. The processes are often performed at temperatures of at least about 1,500° C. and pressures of at least about five gigapascals (5.0 GPa), and for time periods of several minutes. Under these conditions, direct diamond-to-diamond bonds between diamond crystals may be catalyzed using a catalyst material such as, for example, cobalt metal or a cobalt-based metal alloy. In accordance with embodiments of the present invention, however, the working layer 10 may be at least substantially free of catalyst material. In some embodiments, cutting elements (like the cutting element 6 and the cutting element 6') may be formed using an HTHP processes and systems in which the operating parameters are selected to prevent, minimize, or reduce the formation of direct diamond-to-diamond bonds between the diamond crystals in the working layer 10. For example, the high temperatures and high pressures may be maintained for reduced time periods relative to previously known HTHP processes used to form polycrystalline diamond material. By way of example and not limitation, the high temperatures (e.g., temperatures higher than about 1,500° C.) and high pressures (e.g., pressures higher than about 5.0 GPa) of HTHP processes used to form embodiments of cutting elements of the present invention may be maintained for about one minute (1 min.) or less, about thirty seconds (30 sec.) or less, about ten seconds (10 sec.) or less, or even about three seconds (3.0 sec.) or less.

In some embodiments, the composition of the matrix material used to form the matrix phase 12 may be selected to have reduced catalytic activity, if any, to prevent, minimize, or reduce the tendency of the matrix material to catalyze the formation of direct diamond-to-diamond bonds between the diamond crystals in the working layer 10.

Other means may also be employed to maintain diamond quality while minimizing or reducing the formation of polycrystalline diamond material in the working layer 10, such as, for example, maintaining precise control over the distribution of diamond particles in the working layer 10 prior to the sintering process to prevent or reduce agglomeration of diamond crystals which might bond to one another during the sintering process. As another example, diamond particles may be at least partially coated (e.g., encapsulated) with a coating comprising at least one of W, Ti, Ta, and Si, carbides of one or more of these elements, and borides of one or more of these elements. Alternatively, the diamond particles may be at least partially coated or encapsulated with particles of tungsten carbide or tungsten carbide and cobalt, sometimes referred to in the art as "pelletized" diamond. Such coatings may at least partially prevent direct diamond-to-diamond contact to inhibit the formation of a continuous polycrystalline diamond phase. Other suitable cermets, ceramics, or metal alloys may alternatively be used to coat or encapsulate the diamond particles prior to sintering.

Briefly, to form a cutting element like the cutting elements 6, 6' using an HTHP process, a preformed substrate 8 may be placed in a crucible, and particles of matrix material and diamond crystals may be provided on the substrate 8. The crucible may be formed to impart a desired shape to the cutting element 6, such as a cylinder, dome, cone, chisel, ovoid, or other desirable shape. The particles of matrix material and the diamond crystals may be provided on the substrate 8 by any means known in the art. The crucible then may be subjected to high temperatures and high pressures using an HTHP system to cause the particles of matrix material to bond to one another (i.e., sinter) and form a continuous matrix phase 12.

In additional embodiments, working layers of cutting elements (like the cutting element 6 and the cutting element 6') may be formed using sintering processes (i.e., non-HTHP processes) at temperatures below about 1,100° C. and pressures below about one gigapascal (1.0 GPa). In some embodiments, such sintering processes may be carried out at temperatures below about 1,000° C. and pressures below about ten megapascals (10.0 MPa) (e.g., atmospheric pressure or even under vacuum). Such sintering processes may be formed in a non-HTHP hot press, an atmospheric furnace, or a vacuum furnace.

For example, in a non-HTHP hot press, a preformed substrate 8 may be placed in a mold or die, and particles of matrix material and diamond crystals may be provided on the substrate 8. The mold or die may be formed to impart a desired shape to the cutting element to be formed. Pressure and heat may then be applied to the mold or die to cause the particles of matrix material to bond to one another and form a continuous matrix phase 12. Pressure may be applied to the mold or die using an axial press (uni-axial or multi-axial) or a hydrostatic pressure transmission medium (e.g., a fluid). The mold or die may be heated during the sintering process using electrical heating elements, resistance heating, an induction heating element, or combustible materials.

In order to avoid degradation of the diamond crystals (e.g., graphitization of the diamond material) and to avoid the formation of diamond-to-diamond bonds between the diamond crystals), the sintering temperature (in non-HTHP processes) may be maintained below about 1,100° C. and pressures below about one gigapascal (1.0 GPa). To ensure that the particles of matrix material are capable of sintering at such temperatures, the matrix material may include at least one melting point reducing constituent such that the matrix material exhibits one of a melting temperature and a solidus temperature (i.e., the temperature of the solidus line of the phase diagram for the matrix material at the particular composition of the matrix material). For example, the matrix material may have a composition as disclosed in U.S. Patent Application Publication No. 2005/0211475 A1. Furthermore, the sintering process may be carried out in an at least substantially inert atmosphere (i.e., an atmosphere that does not facilitate the degradation of the diamond material to graphite or amorphous carbon). As an example, sintering may take place in an argon atmosphere at atmospheric pressure at about 1050° C. Alternatively, sintering may occur in a vacuum at the same approximate temperature.

Thus, in accordance with embodiments of methods of the present invention, a cutting element 6, 6' for use in subterranean drilling applications may be fabricated by forming at least one transition layer 9, 9' and at least one working layer 10, bonding the transition layer 9, 9', to a substrate 8, and bonding the working layer 10 to the transition layer 9, 9' on a side thereof opposite the substrate 8.

In some embodiments, the transition layer 9, 9' and the working layer 10 may be formed simultaneously on a substrate 8. The transition layer 9, 9' may be formed by mixing a first plurality of discrete diamond crystals with a first plurality of matrix particles each comprising a first metal matrix material to form a first mixture of solid matter. The first mixture may be formulated such that the first plurality of discrete diamond crystals comprises about 50% by volume or less of the solid matter of the first mixture. The first mixture may be sintered to form a transition layer including the first plurality of discrete diamond crystals (a discontinuous diamond phase 13) dispersed within a continuous first matrix phase (a continuous matrix phase 12) formed from the first plurality of matrix particles. Similarly, the working layer 10 may be formed by mixing a second plurality of discrete diamond crystals with a second plurality of matrix particles each comprising a second metal matrix material to form a second mixture of solid matter. The second mixture may be formulated such that the second plurality of discrete diamond crystals comprises at least about 50% by volume of the solid matter of the second mixture. The second mixture may be sintered to form a working layer 10 at least substantially free of polycrystalline diamond material and including the second plurality of discrete diamond crystals dispersed (a discontinuous diamond phase 13) within a continuous second matrix phase (a continuous matrix phase 12) formed from the second plurality of matrix particles.

The working layer 10 may be bonded to the transition layer 9, 9' by simultaneously sintering the first mixture to form the transition layer 9, 9' and sintering the second mixture to form the working layer 10 while the first mixture is in contact with the second mixture. Similarly, the transition layer 9, 9' may be bonded to a preformed substrate 8 by sintering the first mixture to form the transition layer 9, 9' while the first mixture is in contact with the preformed substrate 8. In other embodiments, however, the substrate 8 may be formed by sintering a powder mixture at the same time the transition layer 9, 9' and the working layer 10 are formed by sintering. In such embodiments, the transition layer may be bonded to the substrate 8 during the sintering process by simultaneously sintering the first mixture to form the transition layer 9, 9' and sintering a substrate precursor mixture to form the substrate 8 while the first mixture contacts the substrate precursor mixture.

Although a roller cone rotary drill bit is described hereinabove as an example of an embodiment of an earth-boring tool of the present invention, other types of earth-boring tools may also embody the present invention. For example, fixed-cutter rotary drill bits, diamond impregnated bits, percussion bits, coring bits, eccentric bits, reamer tools, casing drilling heads, bit stabilizers, mills, and other earth-boring tools may include cutting elements as previously described herein, and may also embody the present invention.

While the present invention has been described herein with respect to certain embodiments, those of ordinary skill in the art will recognize and appreciate that it is not so limited. Rather, many additions, deletions, and modifications to the embodiments described herein may be made without departing from the scope of the invention as hereinafter claimed, and legal equivalents. In addition, features from one embodiment may be combined with features of another embodiment while still being encompassed within the scope of the invention as contemplated by the inventors.

What is claimed is:

1. A cutting element for use in subterranean drilling applications, comprising:

a substrate;

at least one transition layer bonded to the substrate, the at least one transition layer comprising:

a continuous first matrix phase; and a discontinuous first diamond phase dispersed throughout the first matrix phase, wherein the volume percentage of the first diamond phase in the at least one transition layer is about 50% or less; and a working layer bonded to the at least one transition layer on a side thereof opposite the substrate, the working layer comprising:

a continuous second matrix phase; and a discontinuous second diamond phase dispersed throughout the second matrix phase, wherein the volume percentage of the second diamond phase in the working layer is at least about 50%, the volume percentage of the second diamond phase in the working layer is greater than the volume percentage of the first diamond phase in the at least one transition layer, and the working layer is at least substantially free of polycrystalline diamond material.

2. The cutting element of claim 1, wherein each of the at least one transition layer and the working layer further comprises another discontinuous hard phase.

3. The cutting element of claim 2, wherein the another discontinuous hard phase comprises a carbide material.

4. The cutting element of claim 1, wherein the volume percentage of the second diamond phase in the working layer is about 75% or less.

5. The cutting element of claim 1, wherein the at least one transition layer comprises a first transition layer and a second transition layer, the first transition layer bonded directly to the substrate, the second transition layer being interposed between and bonded directly to the first transition layer and the working layer, the second transition layer comprising more diamond by volume than the first transition layer.

6. The cutting element of claim 5, wherein the first transition layer comprises between about 10% and about 37% diamond by volume, and the second transition layer comprises between about 37% and about 63% diamond by volume.

7. The cutting element of claim 1, wherein each of the first matrix phase of the at least one transition layer and the second matrix phase of the working layer comprises a metal alloy based on at least one of iron, cobalt, and nickel, the metal alloy including at least one melting point reducing constituent, the metal alloy having one of a melting point and a solidus point at about 1200° C. or less.

8. The cutting element of claim 1, wherein the substrate comprises a generally cylindrical body having a dome-shaped end, the at least one transition layer and the working layer disposed on a surface of the dome-shaped end of the generally cylindrical body.

9. The cutting element of claim 1, wherein the substrate comprises a cemented tungsten carbide material comprising:

between about 5% and about 20% by weight cobalt or cobalt-based alloy; and between about 80% and about 95% by weight tungsten carbide.

10. The cutting element of claim 1, wherein at least one of the discontinuous first diamond phase and the discontinuous second diamond phase comprises a plurality of diamond particles forming a gradient in diamond particle concentration within at least one of the at least one transition layer and the working layer.

11. The cutting element of claim 10, wherein the gradient in diamond particle concentration comprises a continuous gradient from the at least one transition layer to the working layer.

12. The cutting element of claim 1, wherein at least one of the discontinuous first diamond phase and the discontinuous second diamond phase comprises a plurality of diamond particles forming a gradient in average diamond particle size within at least one of the at least one transition layer and the working layer.

13. The cutting element of claim 1, wherein at least one of the discontinuous first diamond phase and the discontinuous second diamond phase comprises a plurality of pelletized diamonds.

14. An earth-boring tool, comprising:

a body; and at least one cutting element carried by the body, comprising:

a cutting element substrate secured to the body;

at least one transition layer bonded to the cutting element substrate, the at least one transition layer comprising:

a continuous first matrix phase; and a discontinuous first diamond phase dispersed throughout the first matrix phase; and a working layer bonded to the at least one transition layer on a side thereof opposite the cutting element substrate, the working layer comprising:

a continuous second matrix phase; and a discontinuous second diamond phase dispersed throughout the second matrix phase, a volume percentage of the second diamond phase in the working layer being greater than a volume percentage of the first diamond phase in the at least one transition layer, the discontinuous second diamond phase at least substantially comprised by isolated single diamond crystals at least substantially surrounded by the second matrix phase.

15. The earth-boring tool of claim 14, wherein each of the first matrix phase and the second matrix phase comprises a cemented carbide material.

16. The earth-boring tool of claim 14, wherein the volume percentage of the first diamond phase in the at least one transition layer is about 50% or less, and wherein the volume percentage of the second diamond phase in the working layer is at least about 50%.

17. The earth-boring tool of claim 16, wherein the volume percentage of the second diamond phase in the working layer is about 75% or less.

18. The earth-boring tool of claim 16, wherein the at least one transition layer comprises a first transition layer and a second transition layer, the first transition layer bonded directly to the cuttting element substrate, the second transition layer being interposed between and bonded directly to the first transition layer and the working layer, the second transition layer comprising more diamond by volume than the first transition layer.

19. The earth-boring tool of claim 18, wherein the first transition layer comprises between about 10% and about 37% diamond by volume, and the second transition layer comprises between about 37% and about 63% diamond by volume.

20. The earth-boring tool of claim 14, wherein each of the first matrix phase of the at least one transition layer and the second matrix phase of the working layer comprises a metal alloy based on at least one of iron, cobalt, and nickel, the metal alloy including at least one melting point reducing constituent, the metal alloy having one of a melting point and a solidus point at about 1200° C. or less.

21. The earth-boring tool of claim 14, wherein the body comprises a roller cone of an earth-boring rotary drill bit.

22. The earth-boring tool of claim 21, wherein the cutting element substrate comprises a generally cylindrical body having a dome-shaped end, at least a portion of the generally cylindrical body disposed within a recess in a surface of the roller cone, the at least one transition layer and the working layer of the at least one cutting element disposed on a surface of the dome-shaped end of the generally cylindrical body.

23. The earth-boring tool of claim 14, wherein at least one of the discontinuous first diamond phase and the discontinuous second diamond phase comprises a plurality of diamond particles forming a gradient in diamond particle concentration within at least one of the at least one transition layer and the working layer.

24. The earth-boring tool of claim 23, wherein the gradient in diamond particle concentration comprises a continuous gradient from the at least one transition layer to the working layer.

25. The earth-boring tool of claim 14, wherein at least one of the discontinuous first diamond phase and the discontinuous second diamond phase comprises a plurality of diamond particles forming a gradient in average diamond particle size within at least one of the at least one transition layer and the working layer.

26. The earth-boring tool of claim 14, wherein at least one of the discontinuous first diamond phase and the discontinuous second diamond phase comprises a plurality of pelletized diamond crystals.

27. A method of fabricating a cutting element for use in subterranean drilling applications, the method comprising:

mixing a first plurality of discrete diamond crystals with a first plurality of matrix particles each comprising a first metal matrix material to form a first mixture of solid matter, and formulating the first mixture such that the first plurality of discrete diamond crystals comprises about 50% by volume or less of the solid matter of the first mixture;

mixing a second plurality of discrete diamond crystals with a second plurality of matrix particles each comprising a second metal matrix material to form a second mixture of solid matter, and formulating the second mixture such that the second plurality of discrete diamond crystals comprises at least about 50% by volume of the solid matter of the second mixture;

sintering the first mixture to form a transition layer including the first plurality of discrete diamond crystals dispersed within a continuous first matrix phase formed from the first plurality of matrix particles;

sintering the second mixture to form a working layer at least substantially free of polycrystalline diamond material and including the second plurality of discrete diamond crystals dispersed within a continuous second matrix phase formed from the second plurality of matrix particles;

bonding the transition layer to a substrate; and bonding the working layer to the transition layer on a side thereof opposite the substrate.

28. The method of claim 27, wherein bonding the working layer to the transition layer comprises:

contacting the first mixture adjacent the second mixture; and simultaneously sintering the first mixture to form the transition layer and sintering the second mixture to form the working layer while the first mixture contacts the second mixture.

29. The method of claim 28, wherein bonding the transition layer to the substrate comprises:

contacting the first mixture with the substrate; and sintering the first mixture to form the transition layer while the first mixture contacts the substrate.

30. The method of claim 29, wherein bonding the transition layer to the substrate comprises:

contacting the first mixture with a substrate precursor mixture; and simultaneously sintering the first mixture to form the transition layer and sintering the substrate precursor mixture to form the substrate while the first mixture contacts the substrate precursor mixture.

31. The method of claim 27, wherein sintering the second mixture to form the working layer comprises sintering the second mixture at a pressure of at least about 5.0 GPa and a temperature of at least about 1,500° C. for a time of less than about one minute (1.0 min.).

32. The method of claim 27, wherein sintering the second mixture to form the working layer comprises sintering the second mixture at a pressure below about 1.0 GPa and a temperature below about 1,100° C.

33. The method of claim 27, wherein sintering the second mixture to form the working layer comprises sintering the second mixture at a pressure below about 10.0 MPa and a temperature below about 1,000° C.

34. The method of claim 33, wherein sintering the second mixture to form the working layer comprises sintering the second mixture in an at least substantially inert atmosphere.

35. The method of claim 27, further comprising bonding the cutting element to a body of an earth-boring tool.

36. The method of claim 27, wherein at least one of mixing a first plurality of discrete diamond crystals with a first plurality of matrix particles and mixing a second plurality of discrete diamond crystals with a second plurality of matrix particles comprises randomly mixing at least one of the first plurality of discrete diamond crystals with the first plurality of matrix particles and the second plurality of discrete diamond crystals with the second plurality of matrix particles.

37. The method of claim 27, wherein at least one of mixing a first plurality of discrete diamond crystals with a first plurality of matrix particles and mixing a second plurality of discrete diamond crystals with a second plurality of matrix particles comprises distributing at least one of the first plurality of discrete diamond crystals and the first plurality of matrix particles and the second plurality of discrete diamond crystals and the second plurality of matrix particles to form a gradient in diamond crystal concentration.

38. The method of claim 27, wherein at least one of mixing a first plurality of discrete diamond crystals with a first plurality of matrix particles and mixing a second plurality of discrete diamond crystals with a second plurality of matrix particles comprises distributing at least one of the first plurality of discrete diamond crystals and the first plurality of matrix particles and the second plurality of discrete diamond crystals and the second plurality of matrix particles to form a gradient in average diamond crystal size.

39. The method of claim 27, further comprising at least partially coating the discrete diamond crystals of at least one of the first plurality of discrete diamond crystals and the second plurality of discrete diamond crystals with a coating comprising at least one of W, Ti, Ta, or Si, a carbide of W, Ti, Ta, or Si, and a boride of W, Ti, Ta, or Si.

* * * * *